US007185970B2

(12) United States Patent
Hamasaki

(10) Patent No.: US 7,185,970 B2
(45) Date of Patent: Mar. 6, 2007

(54) INKJET PRINTING APPARATUS

(75) Inventor: Yuji Hamasaki, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 286 days.

(21) Appl. No.: 10/765,991

(22) Filed: Jan. 29, 2004

(65) Prior Publication Data

US 2004/0183853 A1 Sep. 23, 2004

(30) Foreign Application Priority Data

Jan. 31, 2003 (JP) ..... 2003-024968

(51) Int. Cl.
*B41J 2/165* (2006.01)
*B41J 2/175* (2006.01)

(52) U.S. Cl. ..... 347/23; 347/29; 347/30; 347/32; 347/33; 347/35; 347/86

(58) Field of Classification Search ..... 347/22–24, 347/29–35, 86
See application file for complete search history.

(56) References Cited

U.S. PATENT DOCUMENTS

| | | | |
|---|---|---|---|
| 4,313,124 | A | 1/1982 | Hara |
| 4,345,262 | A | 8/1982 | Shirato et al. |
| 4,459,600 | A | 7/1984 | Sato et al. |
| 4,463,359 | A | 7/1984 | Ayata et al. |
| 4,558,333 | A | 12/1985 | Sugitani et al. |
| 4,608,577 | A | 8/1986 | Hori |
| 4,723,129 | A | 2/1988 | Endo et al. |
| 4,740,796 | A | 4/1988 | Endo et al. |
| 6,142,600 | A | 11/2000 | Takahashi et al. |
| 6,318,834 | B1 | 11/2001 | Otsuka et al. |
| 6,447,095 | B1 | 9/2002 | Kanda et al. |
| 6,476,926 | B1 | 11/2002 | Yano et al. |

FOREIGN PATENT DOCUMENTS

| | | |
|---|---|---|
| EP | 1 025 997 | 8/2000 |
| JP | 54-56847 | 5/1979 |
| JP | 59-123670 | 7/1984 |
| JP | 59-138461 | 8/1984 |
| JP | 60-71260 | 4/1985 |
| JP | 8-39830 | 2/1996 |
| JP | 8-174863 | 7/1996 |
| JP | 9-11492 | 1/1997 |

*Primary Examiner*—Shih-Wen Hsieh
(74) *Attorney, Agent, or Firm*—Fitzpatrick, Cella, Harper & Scinto

(57) ABSTRACT

In an inkjet printing apparatus which includes a printhead that discharges ink and an ink tank detachably attached to the printhead, and executes printing by using the printhead that discharges the ink supplied from the ink tank, an ink tank detection section detects the presence/absence of the ink tank. On the basis of the detection result, a control circuit inhibits the cleaning operation of the printhead.

6 Claims, 7 Drawing Sheets

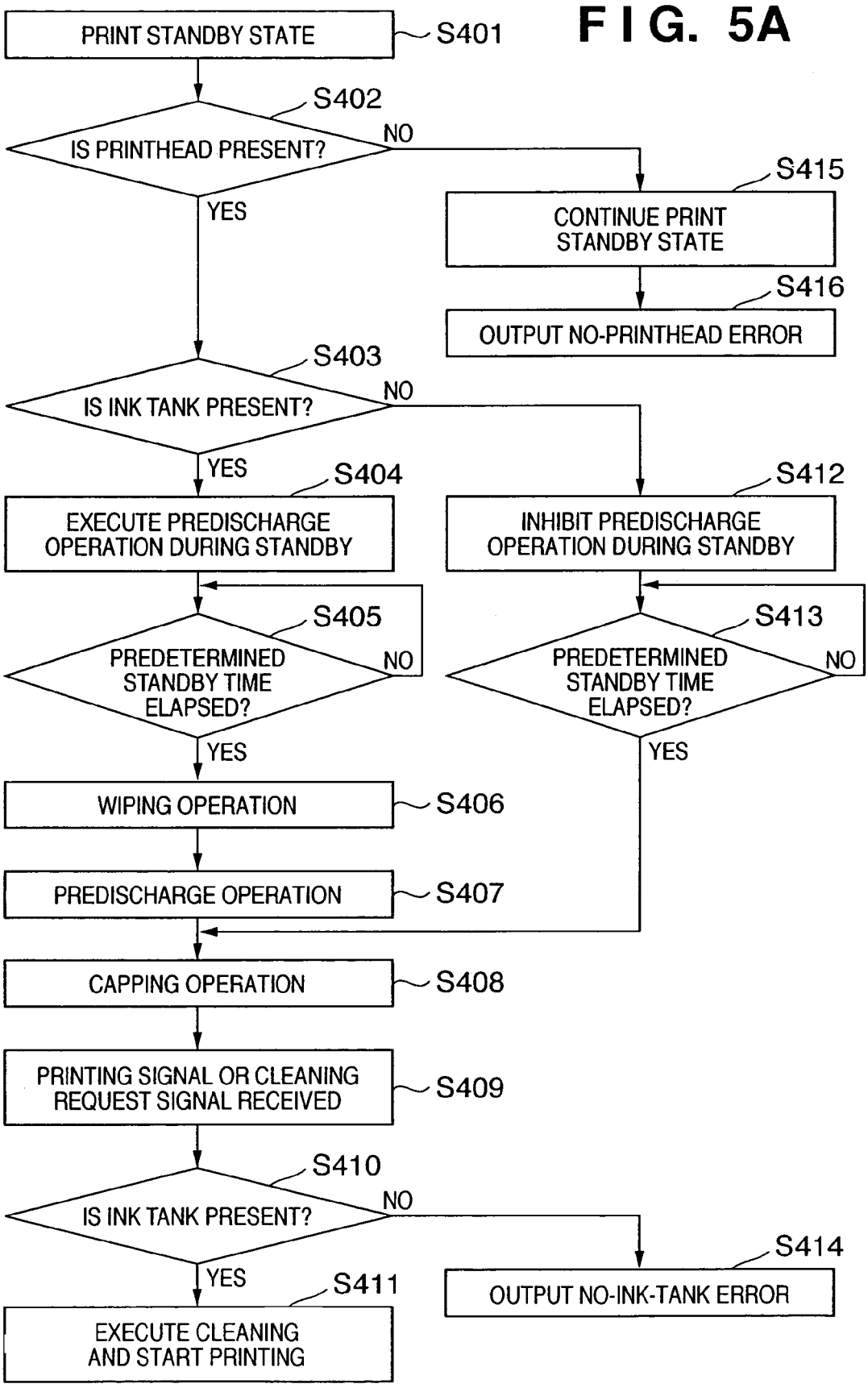
FIG. 5A
PRINT STANDBY STATE
S401
S402
IS PRINTHEAD PRESENT?
NO
YES
S415
CONTINUE PRINT STANDBY STATE
S416
OUTPUT NO-PRINTHEAD ERROR
S403
IS INK TANK PRESENT?
NO
YES
S404
EXECUTE PREDISCHARGE OPERATION DURING STANDBY
S412
INHIBIT PREDISCHARGE OPERATION DURING STANDBY
S405
PREDETERMINED STANDBY TIME ELAPSED?
NO
YES
S413
PREDETERMINED STANDBY TIME ELAPSED?
NO
YES
WIPING OPERATION
S406
PREDISCHARGE OPERATION
S407
CAPPING OPERATION
S408
PRINTING SIGNAL OR CLEANING REQUEST SIGNAL RECEIVED
S409
S410
IS INK TANK PRESENT?
NO
YES
S414
OUTPUT NO-INK-TANK ERROR
S411
EXECUTE CLEANING AND START PRINTING

FIG. 6

| ELAPSE TIME | INK VACUUM RECOVERY LEVEL | | INK PREDISCHARGE LEVEL | |
|---|---|---|---|---|
| | BK | COLOR | BK | COLOR |
| 120HRS | 2 | 2 | 2 | 2 |
| 240HRS | 3 | 3 | 3 | 3 |
| 720HRS | 4 | 4 | 4 | 4 |
| 1440HRS | 5 | 5 | 5 | 5 |
| 2160HRS | 6 | 6 | 6 | 6 |
| | | | | |
| NORMAL STATE | 1 | 1 | 1 | 1 |

INKJET PRINTING APPARATUS

FIELD OF THE INVENTION

The present invention relates to an ink-jet printing technique for, in an apparatus having a printhead which discharges ink and an ink tank detachably attached to the printhead, executing printing by using the printhead that discharges ink supplied from the ink tank.

BACKGROUND OF THE INVENTION

For inkjet printing apparatuses, a so-called tank exchange scheme has been proposed in consideration of the convenience and cost effectiveness for apparatus users. In this scheme, ink tanks that store ink for inkjet printing can independently be set for a printhead. When the ink is running out, only the ink tank is exchanged.

On the other hand, conventionally, the printhead can easily be detached/attached to/from the printing apparatus main body so that the apparatus user can easily exchange the printhead with a new one in case of failure in the printhead. In inkjet printing apparatuses which are relatively expensive and have large apparatus volumes, and inkjet printheads and ink tanks used for these apparatuses, the ink tank has electrical or optical elements (parts). The ink-jet printing apparatuses have reading elements for the electrical or optical elements.

In an inkjet printing apparatus having the above-described arrangement, the reading elements and reading function are mainly used for ink level detection. They are not used to detect the presence/absence of the ink tank itself. Even when no ink tank is attached at all, control for cleaning is sometimes executed as in an ink tank attached state.

In inkjet printing apparatuses which are relatively inexpensive and have small apparatus volumes, and inkjet printheads and ink tanks used for these apparatuses, there can be neither special detection elements nor a detection function to detect the presence/absence of the ink tank. Exchange or attachment/detachment of the ink tank is estimated by determining conditions such as the open time of the front cover of the inkjet printing apparatus. In this case, the presence/absence of the ink tank cannot directly be detected. Even when no ink tank is attached at all, control for cleaning is executed as in an ink tank attached state.

Even in inkjet printing apparatuses which have a mechanical detection function of detecting the presence/absence of the ink tank, the same control for cleaning as in an ink tank attached state is executed even when no ink tank is attached at all.

In Japanese Patent Laid-Open No. 9-11492 or 8-039830 (which corresponds to U.S. Pat. No. 6,447,095), the presence/absence of the ink tank is detected to prevent the ink from hardening in the inkjet printhead when the apparatus is left for a long time in an ink tank unattached state. Especially, control has been proposed, in which when no ink tank is attached, ink is completely discharged from the ink channel in the inkjet printhead by using a recovery mechanism such as a suction mechanism or ink predischarge mechanism.

However, in the conventional inkjet printing apparatus, as described above, the same cleaning operation is performed independently of the presence/absence of the ink tank. When the ink tank is detached because ink in it is completely consumed, the ink level in the inkjet printhead is also already zero or almost zero.

In this state, the same cleaning sequence as in the ink tank attached state, i.e., a cleaning operation such as an ink predischarge operation, wiping operation, or ink suction operations is executed. Particularly, in the ink predischarge operation, ink discharge energy generation elements are energized although there is no ink. In this case, the energy generation elements are damaged and adversely affect the normal ink discharge performance, as is known.

Similarly, when the wiping operation is executed, the wiping member abuts against the face surface of the inkjet printhead with ink discharge nozzles and slides although the ink level is almost zero. This may degrade the water repellency of the face surface of the inkjet printhead and decrease the reliability of ink discharge.

In addition, since a color other than a predetermined color is pushed into the inkjet printhead by the wiping operation, and the above-described ink predischarge operation is insufficiently executed, a problem such as color mixing is posed by the residual colors other than the predetermined color.

The ink suction operation itself does not damage the inkjet printhead. However, when the ink suction operation is executed, the inkjet printhead receives the same damage as described above because of the wiping operation and ink predischarge operation, which are included in the series of cleaning operations in ink suction.

When ink is discharged from the inkjet printhead in the ink tank unattached state, as in Japanese Patent Laid-Open No. 9-11492 or 8-039830, clogging in the ink channel of the inkjet printhead by ink remaining in it can be prevented. However, as the resolution and image quality of inkjet printing apparatuses are recently becoming higher, the discharge amount of the ink-jet printhead is decreasing. To realize such a small ink discharge amount, the ink discharge nozzle area must be reduced. In small ink discharge nozzles, a hardening substance is generated near them by a small amount of ink that remains when the ink in the inkjet printhead is discharged. This adversely affects ink discharge.

SUMMARY OF THE INVENTION

The present invention has been made to solve the above problems, and has as its object to provide an inkjet printing technique capable of reducing damage to the printhead and prolonging the service life of the apparatus.

According to the present invention, the foregoing object is attained by providing an inkjet printing apparatus which includes a printhead that discharges ink and an ink tank detachably attached to the printhead, and executes printing by using the printhead that discharges the ink supplied from the ink tank, comprising:

detection means for detecting presence/absence of the ink tank;

cleaning means for cleaning the printhead; and control means for inhibiting a cleaning operation by the cleaning means on the basis of a detection result from the detection means.

In a preferred embodiment, when the detection result from the detection means indicates that the ink tank is not attached to the printhead, the control means inhibits the cleaning operation by the cleaning means.

In a preferred embodiment, when the ink tank is not attached to the printhead, and a printing signal is received, the control means also inhibits a printing operation by the printhead.

In a preferred embodiment, the apparatus further comprises output means for, when a cleaning request signal or a printing signal is received in a state in which the detection means detects that the ink tank is not attached to the printhead, outputting information representing that the ink tank is not attached to the printhead.

In a preferred embodiment, the ink tank comprises a plurality of ink tanks which store a plurality of types of ink, respectively, and each of the plurality of ink tanks is detachably attached to the printhead.

According to the presenting invention, the foregoing object is attained by providing an ink-jet printing apparatus which includes a printhead that discharges ink and an ink tank detachably attached to the printhead, and executes printing by using the printhead that discharges the ink supplied from the ink tank, comprising:

detection means for detecting presence/absence of the ink tank;

cleaning means for cleaning the printhead; and control means for controlling a cleaning operation by the cleaning means on the basis of an unattached time of the ink tank, which is obtained on the basis of a detection result from the detection means.

In a preferred embodiment, the control means controls a level of the cleaning operation by the cleaning means on the basis of the unattached time of the ink tank.

In a preferred embodiment, the apparatus further comprises measurement means for measuring the unattached time of the ink tank on the basis of the detection result from the detection means, and storage means for storing the unattached time of the ink tank, which is measured by the measurement means, and wherein the control means controls the cleaning operation by the cleaning means on the basis of the unattached time of the ink tank, which is stored in the storage means.

In a preferred embodiment, the control means comprises acquisition means for acquiring, on the basis of the detection result from the detection means, first time when the ink tank is detached and second time when the ink tank is attached later, and determination means for determining the unattached time of the ink tank on the basis of the first and second times acquired by the acquisition means, and wherein the control means controls the cleaning operation by the cleaning means on the basis of the unattached time of the ink tank, which is determined by the determination means.

According to the present invention, the foregoing object is attained by providing a method of controlling an inkjet printing apparatus which includes a printhead that discharges ink and an ink tank detachably attached to the printhead, and executes printing by using the printhead that discharges the ink supplied from the ink tank, comprising:

a detection step of detecting presence/absence of the ink tank; and a control step of inhibiting a cleaning operation by a cleaning section that cleans the printhead, on the basis of a detection result in the detection step.

According to the present invention, the foregoing object is attained by providing a method of controlling an inkjet printing apparatus which includes a printhead that discharges ink and an ink tank detachably attached to the printhead, and executes printing by using the printhead that discharges the ink supplied from the ink tank, comprising:

a detection step of detecting presence/absence of the ink tank; and a control step of controlling a cleaning operation by a cleaning section that cleans the printhead, on the basis of an unattached time of the ink tank, which is obtained on the basis of a detection result in the detection step.

According to the present invention, the foregoing object is attained by providing a program which implements control of an inkjet printing apparatus which includes a printhead that discharges ink and an ink tank detachably attached to the printhead, and executes printing by using the printhead that discharges the ink supplied from the ink tank, comprising:

a program code for a detection step of detecting presence/absence of the ink tank; and a program code for a control step of inhibiting a cleaning operation by a cleaning section that cleans the printhead, on the basis of a detection result in the detection step.

According to the present invention, the foregoing object is attained by providing a program which implements control of an inkjet printing apparatus which includes a printhead that discharges ink and an ink tank detachably attached to the printhead, and executes printing by using the printhead that discharges the ink supplied from the ink tank, comprising:

a program code for a detection step of detecting presence/absence of the ink tank; and a program code for a control step of controlling a cleaning operation by a cleaning section that cleans the printhead, on the basis of an unattached time of the ink tank, which is obtained on the basis of a detection result in the detection step.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 5A is a flow chart showing control of the cleaning operation executed by the inkjet printing apparatus according to the first embodiment of the present invention;

FIG. 6 is a table showing an example of cleaning levels corresponding to ink tank unattached times in the present invention.

DETAILED DESCRIPTION OF THE PREFERRED EMBODIMENTS

Preferred embodiments of the present invention will now be described in detail in accordance with the accompanying drawings.

In this specification, "print" means not only formation of significant information such as a character or graphic pattern but also formation of an image, design, or pattern on printing media by supplying a liquid to printing media in a broader sense regardless of whether the information is significant or insignificant or has become obvious to allow human visual perception. "Print" also means processing of printing media.

"Printing media" mean not only paper sheets used in a general printing apparatus but also any media capable of receiving ink discharged from a printhead, including fabrics, plastic films, and metal plates in a broader sense.

"Ink" should also be interpreted in a broader sense, like definition of "print", and means a liquid which is supplied onto printing media to form an image, design, pattern, or the like or process printing media.

<First Embodiment>

Figure 1:
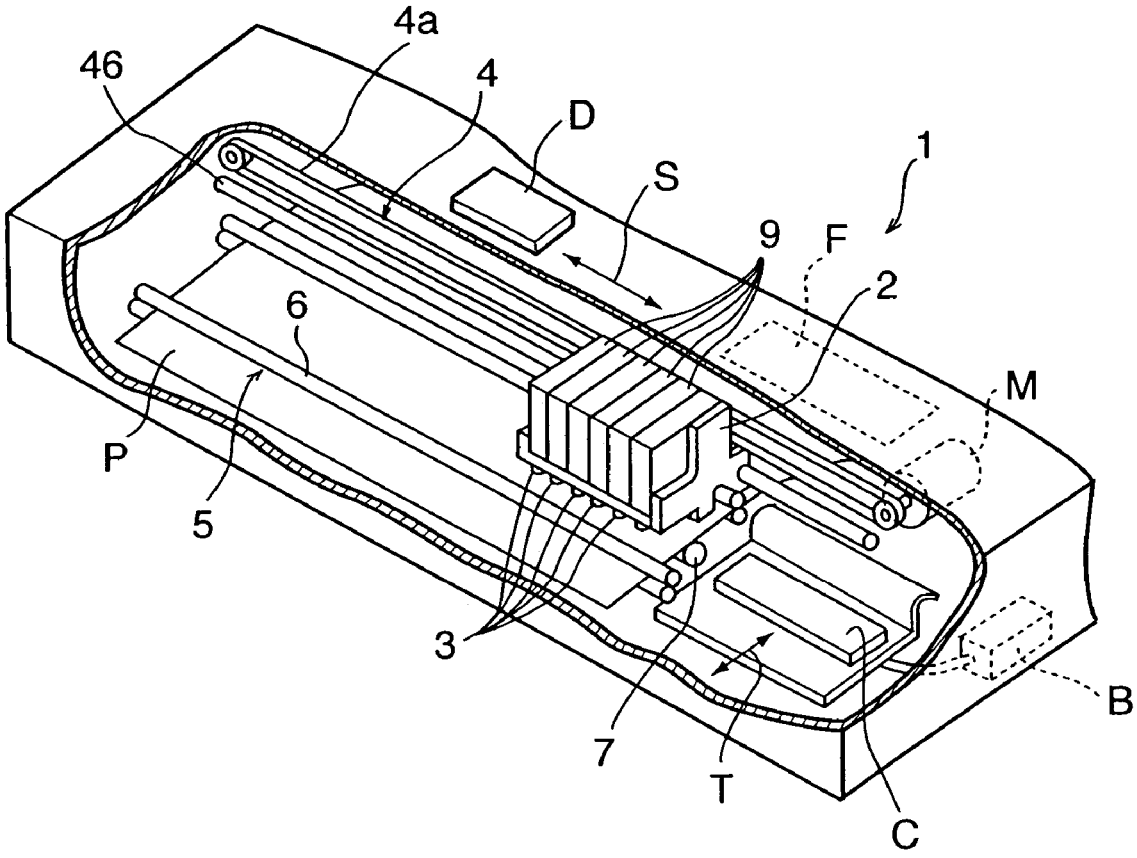
FIG. 1 is a partially cutaway schematic perspective view showing an inkjet printing apparatus having a printhead cleaning function according to the first embodiment of the present invention.
Figure 2:
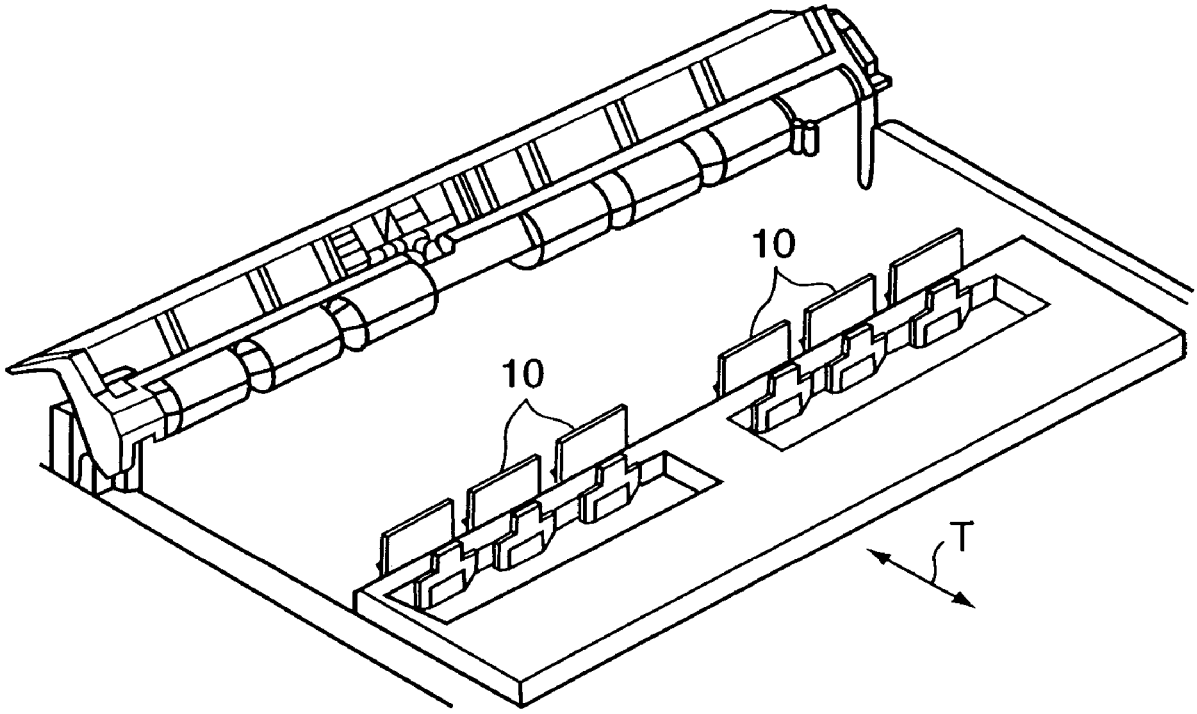
FIG. 2 is a schematic perspective view showing a wiping section as part of the cleaning function according to the first embodiment of the present invention.
Figure 3A:
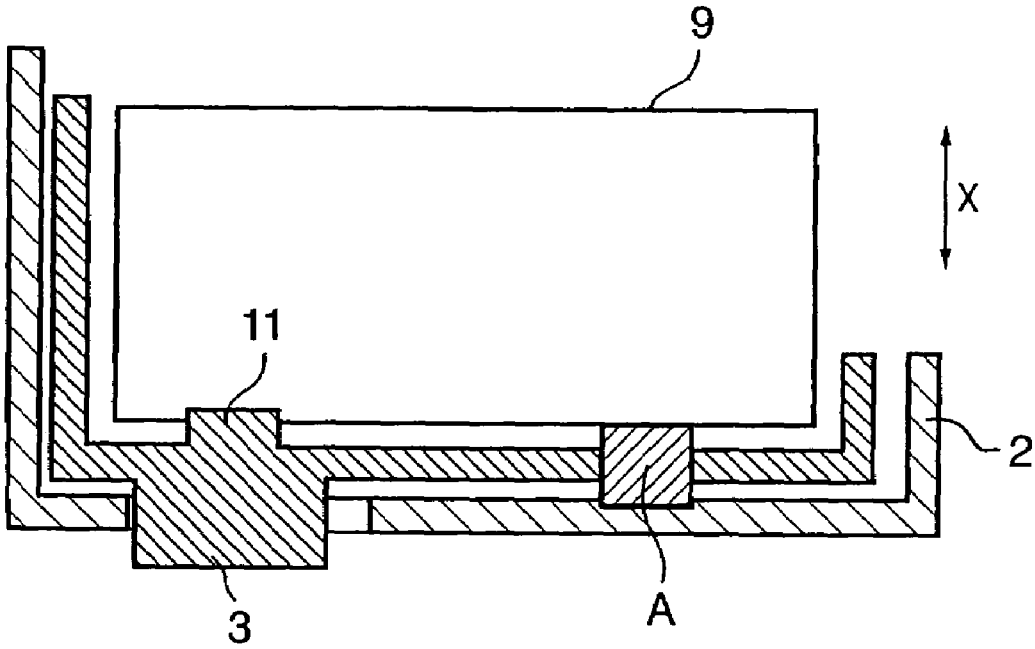
FIG. 3A is a schematic sectional view showing an ink tank detection section according to the first embodiment of the present invention.
Figure 3B:
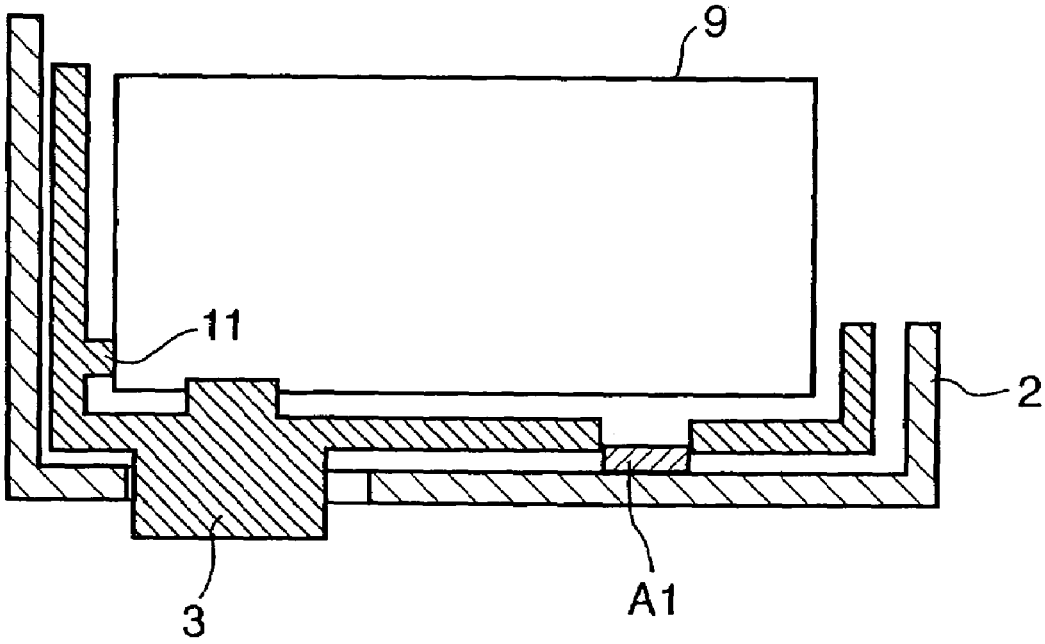
FIG. 3B is a schematic sectional view showing the ink tank detection section according to the first embodiment of the present invention.

FIG. 1 is a partially cutaway schematic perspective view showing an inkjet printing apparatus having a printhead cleaning function according to the first embodiment of the present invention. FIG. 2 is a schematic perspective view showing a wiping section as part of the cleaning function according to the first embodiment of the present invention. FIGS. 3A and 3B are schematic sectional views showing an ink tank detection section according to the first embodiment of the present invention.

Referring to FIGS. 1 to 3B, an inkjet printing apparatus 1 comprises a carriage 2 having an ink-jet printhead 3 (to be simply referred to as a printhead 3 hereinafter), and a driving mechanism 4 which causes a driving motor M to reciprocally move the carriage 2 along a rail 4*b* through an endless belt 4*a*.

The inkjet printing apparatus also comprises an ink tank detection section A (FIG. 3A) which is formed on the carriage 2 to detect the presence/absence (attachment/detachment) of ink tanks 9, a feed mechanism (paper feed mechanism) 5 which conveys (feeds) a printing paper sheet P serving as a printing medium, and a cap C which tightly covers the ink discharge port surface of the printhead 3.

The inkjet printing apparatus further comprises a pump section B which communicates with the cap C to execute an ink vacuum recovery operation in which ink is supplied from the ink tank 9 to the printhead 3 by a vacuum function to remove bubbles and dust from the printhead 3, and wiping sections 10 (FIG. 2) to execute a wiping operation of contact-sliding (wiping out) the ink discharge port surface of the printhead 3.

The printhead 3 is detachably attached to the carriage 2. The ink tank 9 is detachably attached to the printhead 3. The ink stored in the ink tank 9 is supplied to the printhead 3. The carriage 2 and printhead 3 can achieve and maintain necessary electrical connection by appropriately bringing their joint surfaces into contact with each other. When this electrical connection is detected, the presence/absence of the printhead 3 can be detected.

A plurality of ink tanks which store a plurality of kinds of ink to implement color/monochrome printing can be attached/detached to/from the printhead 3. Examples of the types of ink are color inks (Y (yellow), M (magenta), and C (cyan)) and black ink (K (black)).

The printhead 3 is an inkjet printing means using an inkjet printing scheme which discharges ink by using heat energy. The printhead 3 therefore has an electrothermal transducer to generate the heat energy. The printhead 3 executes printing by discharging the ink from the ink discharge port by using a pressure change caused by growth and shrinkage of bubbles by film boiling that occurs due to the heat energy applied by the electrothermal transducer.

The inkjet printing scheme need not always use the above-described heat energy but may use a piezoelectric element.

As shown in FIG. 3A, the ink tank detection section A is formed on the carriage 2. The ink tank detection section A can detect the presence/absence of the ink tank 9 by detecting a mechanical displacement X generated by the presence/absence of contact with the ink tank 9.

As shown in FIG. 3B, an ink tank detection section A1 may be formed by an optical detection element of noncontact scheme or an electrical connection terminal of electrical detection scheme. When the presence/absence of the ink tank 9 should be detected by the respective schemes, elements that implement the respective schemes are prepared in the ink tank 9.

Referring to FIGS. 3A and 3B, both the ink tank detection sections A and A1 are arranged on the carriage 2 such that they are formed under the ink tank 9. The ink tank detection section can be arranged at any arbitrary portion of the carriage 2 without decreasing the effect as long as the presence/absence of the ink tank 9 can be detected there.

To supply the ink from the ink tank 9, the printhead 3 has an ink supply port 11. As shown in FIGS. 3A and 3B, the ink supply port 11 can be arranged at any arbitrary position of the printhead 3 as long as the ink can be supplied to the printhead 3.

A display section D (FIG. 1) that displays the ink tank unattached state can be either a liquid crystal display device or a light-emitting element such as an LED. An operation panel including an exchange key to exchange the printhead 3 or ink tank 9 and an operation key to execute the cleaning operation may be added to the display section D.

The inkjet printing apparatus 1 has a control circuit F which controls various kinds of processing of the inkjet printing apparatus 1, including processing represented by a flow chart (to be described later).

In the inkjet printing apparatus 1, the printing paper sheet P is fed by a feed roller 6 of the feed mechanism 5. Printing on the printing paper sheet P is performed by the printhead 3 on a platen 7.

The cleaning operation of the printhead 3 is executed when the printhead 3 is attached or the ink tank 9 is attached or exchanged, after a nonprinting state continues for a specified time or a specified number of ink dots are discharged, or when the user designates a cleaning request by the key operation or from the printer driver on the host apparatus.

In these cases, the ink vacuum recovery operation is executed first as the cleaning operation. In the ink vacuum recovery operation, the printhead 3 is tightly closed by the cap C and vacuumed by driving the pump section B to supply the ink to the printhead 3 to fill it with the ink and remove bubbles and dust.

After the ink vacuum recovery operation, the wiping operation is executed, in which the wiping sections 10 move in a direction T to remove ink and dust remaining on the ink discharge port surface of the printhead 3 by contact-sliding. After that, the ink predischarge operation is executed. Inks of colors other than a predetermined color are discharged from the respective ink chambers of the printhead 3 by the ink vacuum recovery operation and wiping operation. The cleaning operation is thus ended.

The printhead 3 or ink tank 9 can be attached or exchanged when the front cover of the inkjet printing apparatus 1 is opened or when the exchange key (not shown) is pressed to move the carriage 2 to the central portion of the inkjet printing apparatus or the opening portion of the apparatus.

The above-described cleaning operation is executed when the user who intends printing powers on the inkjet printing apparatus 1, a printing signal is received, or the time or the number of ink dots exceeds the specified value. At this time, the inkjet printing apparatus 1 is in the print standby state or in a state immediately after the end of printing.

During print standby or immediately after the end of printing, the ink predischarge operation is continued for a predetermined time so that the print operation can immediately be started upon receiving the next printing signal. After the elapse of the specified standby time, the wiping operation is executed, and the ink predischarge operation after wiping is executed. Then, the printhead 3 is covered with the cap C (capping operation). In this case, since no pressure change is applied to the printhead 3, unlike the ink vacuum recovery operation, the cap C is open to air except at the joint portion to the printhead 3.

The main components of the control circuit F will be described next with reference to FIG. 4.

Figure 4:
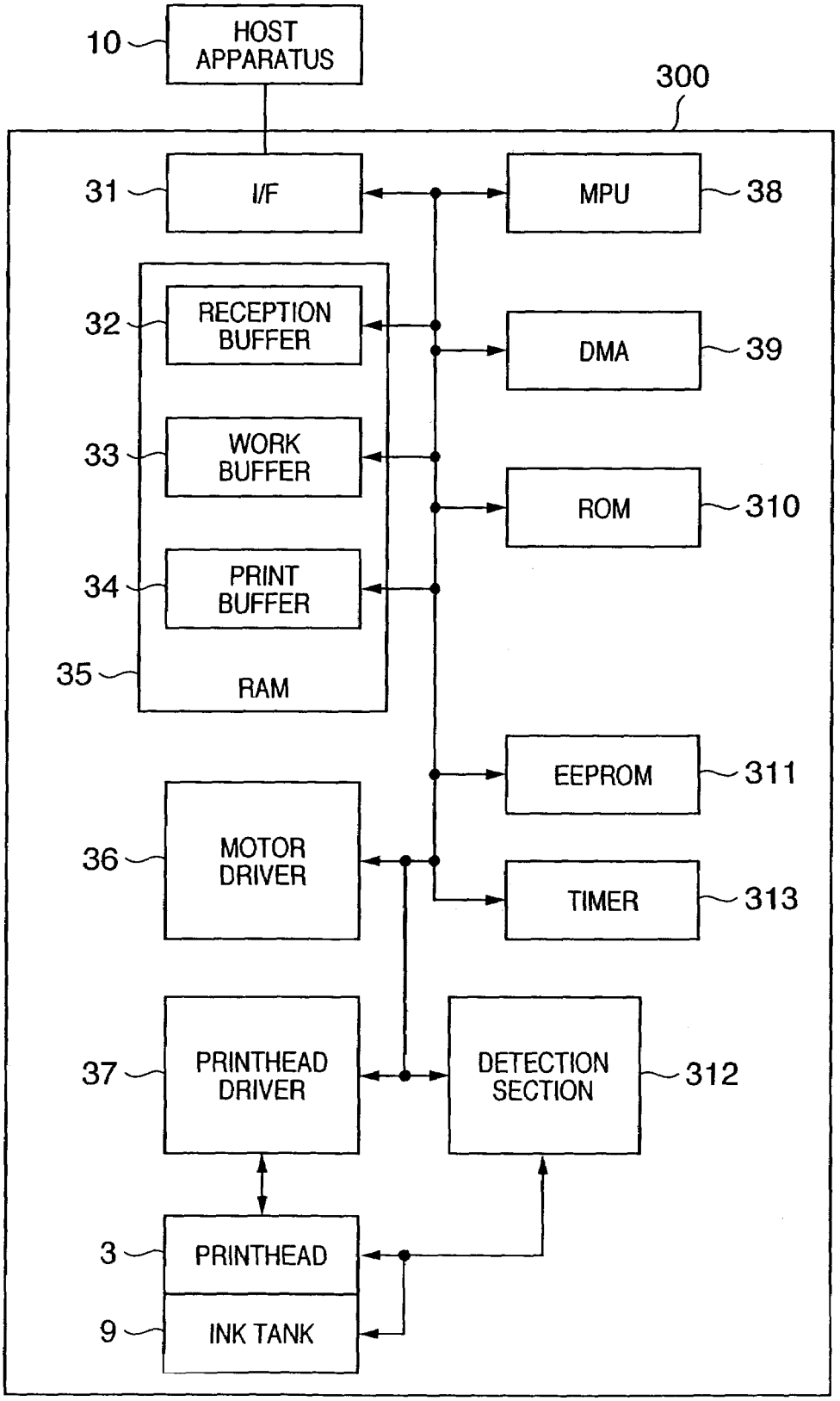
FIG. 4 is a block diagram showing the main components of a control circuit according to the first embodiment of the present invention.

FIG. 4 is a block diagram showing the main components of the control circuit according to the first embodiment of the present invention.

An MPU 38 controls various constituent elements of the inkjet printing apparatus 1. An I/F 31 is connected to an external device such as a host apparatus 10 to transmit/receive various data. As the form of the I/F, either a serial interface or a parallel interface can be used. An example of the serial interface is a USB interface. An example of the parallel interface is a centronics interface.

Reference numeral 35 denotes a RAM. A plurality of dedicated memory areas are ensured in the RAM 35. Particularly, in this embodiment, a reception buffer 32, work buffer 33, and print buffer 34 are ensured. The reception buffer 32 temporarily stores print data (print control information or image data) received from the host apparatus 10. The work buffer 33 functions as a work area for processing executed by the ink-jet printing apparatus 1. The print buffer 34 stores print image data to be actually used for printing.

A motor driver 36 drives the driving motor M to drive the printhead 3 of the inkjet printing apparatus 1 or various motors such as the motor to convey the printing paper sheet P under the control of the MPU 38. A printhead driver 37 drives the printhead 3 under the control of the MPU 38.

A DMA 39 executes data transfer between the plurality of dedicated memory areas on the RAM 35. A ROM 310 stores programs to execute various control operations executed by the inkjet printing apparatus 1 or programs that execute various flow charts to be described later.

An EEPROM 311 stores data such as various parameters necessary for processing executed by the inkjet printing apparatus 1. In place of the EEPROM 311, any other memory such as a DRAM or SRAM that can temporarily store data may be used in accordance with the use or purpose.

A detection section 312 detects various states of the inkjet printing apparatus 1. The detection section 312 includes, e.g., a temperature detection section which detects the temperature of the printhead 3, a paper detection section which detects the presence/absence of the printing paper sheet P, and a head detection section which detects the presence/absence of the printhead 3 as well as the above-described ink tank detection section A (or A1).

A timer 313 measures the ink tank unattached time on the basis of the detection result from the ink tank detection section A (or A1). On the basis of the detection result from the ink tank detection section A (or A1), the timer 313 counts the unattached time of the ink tank 9. In this embodiment, the timer 313 is prepared as an independent component, as shown in FIG. 4. However, it may individually be prepared.

For example, time counting may be executed by the MPU 38, or another component may have the time counting function. The count value is stored in, e.g., the EEPROM 311. The MPU 38 can determine the unattached time of the ink tank 9 by reading out the count value stored in the EEPROM 311.

The host apparatus 10 generates a printing signal to realize print control by the control circuit F (to be described later) and controls output of the printing signal to the inkjet printing apparatus 1. The generation and output control of the printing signal are implemented by a dedicated program, such as a printer driver corresponding to the inkjet printing apparatus 1, installed in the host apparatus 10. The generation and output control of the printing signal may be implemented by dedicated hardware that implements processing executed by the dedicated program.

The host apparatus 10 has standard constituent elements (e.g., a CPU, RAM, ROM, hard disk, external storage device, network interface, display, keyboard, mouse, and the like) mounted on a general-purpose computer.

In the first embodiment, the cleaning operation is controlled on the basis of particularly the attached states of the printhead 3 and ink tank 9.

The cleaning operation here indicates operations of recovering the state of the printhead 3 to a print suitable state, including the ink vacuum recovery operation, wiping operation, and ink predischarge operation.

FIG. 5A is a flow chart showing control of the cleaning operation executed by the inkjet printing apparatus according to the first embodiment of the present invention.

Steps S401 to S416 of the flow chart shown in FIG. 5A are executed under the control of the MPU 38 of the inkjet printing apparatus 1.

First, the printhead 3 or ink tank 9 changes from the exchangeable state to the print standby state wherein the front cover of the inkjet printing apparatus 1 is closed (step S401). The electrical connection between the carriage 2 and the printhead 3 of the inkjet printing apparatus 1 is detected to determine whether the printhead 3 is attached to the carriage 2 (step S402).

If the printhead 3 is not attached (NO in step S402), the flow advances to step S415. On the other hand, when the printhead 3 is attached (YES in step S402), the flow advances to step S403 to cause the ink tank detection section A to determine the presence/absence of the ink tank 9.

If any one or all of the plurality of ink tanks 9 are not attached (NO in step S403), the flow advances to step S412 to inhibit the ink predischarge operation during print standby, which should normally be executed. In this case, the ink predischarge operation is not executed. However, the print standby state is continued assuming that the user is preparing for ink tank exchange or any operation error occurs.

It is then determined whether a predetermined standby time has elapsed (step S413). When the predetermined standby time has not elapsed yet (NO in step S413), the standby state is continued until the predetermined standby time elapses. When the predetermined standby time has elapsed (YES in step S413), the flow advances to step S408 to execute the capping operation.

As described above, when the ink tank 9 is not attached, the capping operation is executed (step S408). At this time, however, the wiping operation (step S406) and the ink predischarge operation (step S407) associated with it are inhibited.

With this arrangement, when the ink level in the printhead 3 is zero or almost zero, damage to the electrothermal transducer of the printhead 3 by the ink predischarge operation and damage to the ink discharge port surface of the printhead 3 by the wiping operation can be suppressed.

When all the ink tanks 9 are attached in step S403 (YES in step S403), the flow advances to step S404 to execute the ink predischarge operation during print standby.

It is then determined whether the predetermined standby time has elapsed (step S405). When the predetermined standby time has not elapsed yet (NO in step S405), the standby state is continued until the predetermined standby time elapses. When the predetermined standby time has elapsed (YES in step S405), the flow advances to step S406 to execute the wiping operation. Next, the ink predischarge operation is executed by controlling the printhead driver 37 (step S407). Then, the capping operation is executed (step S408).

When a printing signal or a cleaning request signal that instructs execution of the cleaning operation is received from the host apparatus 10 (step S409), the ink tank detection section A is caused to determine the presence/absence of the ink tank 9 again (step S410).

When all the ink tanks 9 are attached in step S410 (YES in step S410), the flow advances to step S411 to execute the operation (print operation or cleaning operation) corresponding to the received signal.

If any one or all of the plurality of ink tanks 9 are not attached (NO in step S410), the flow advances to step S414 to inhibit the operation (print operation or cleaning operation) corresponding to the received signal. No-ink-tank error information representing that the ink tanks 9 are not attached is displayed on the display section D (step S414). In addition, the no-ink-tank error information may be transmitted to the host apparatus 10. In this case, the no-ink-tank error information is displayed on the display section of the host apparatus 10.

As described above, when a printing signal or cleaning request signal is received while the ink tank 9 is not attached, the print operation or cleaning operation is inhibited. For this reason, when the ink tank 9 is not attached, print pulse application of the electrothermal transducer of the printhead 3 can be prevented so that damage to the electrothermal transducer can be suppressed.

In addition, the user can be notified that the ink tank 9 is not attached. This can call the user's attention to attachment of the ink tank 9. Furthermore, since it can call the user's attention to attachment of the ink tank 9, an effect for suppressing occurrence of ink tank unattached state for a long time can be expected.

When the printhead 3 is not attached in step S402 (NO in step S402), the flow advances to step S415 to continue the print standby state.

In this print standby state, if a printing signal or cleaning request signal is received from the host apparatus 10, the cleaning operation or print operation is inhibited, and no-printhead error information representing that the printhead 3 is not attached is displayed on the display section D, as in the unattached state of the ink tank 9 (step S416).

In addition, the no-printhead error information may be transmitted to the host apparatus 10. In this case, the no-printhead error information is displayed on the display section of the host apparatus 10.

FIG. 5A shows an example in which a cleaning request signal is received from the host apparatus 10. When the inkjet printing apparatus 1 has an operation key that inputs a cleaning request signal, the processing shown in FIG. 5A can also be applied to the cleaning request signal input from the operation key.

Figure 5B:
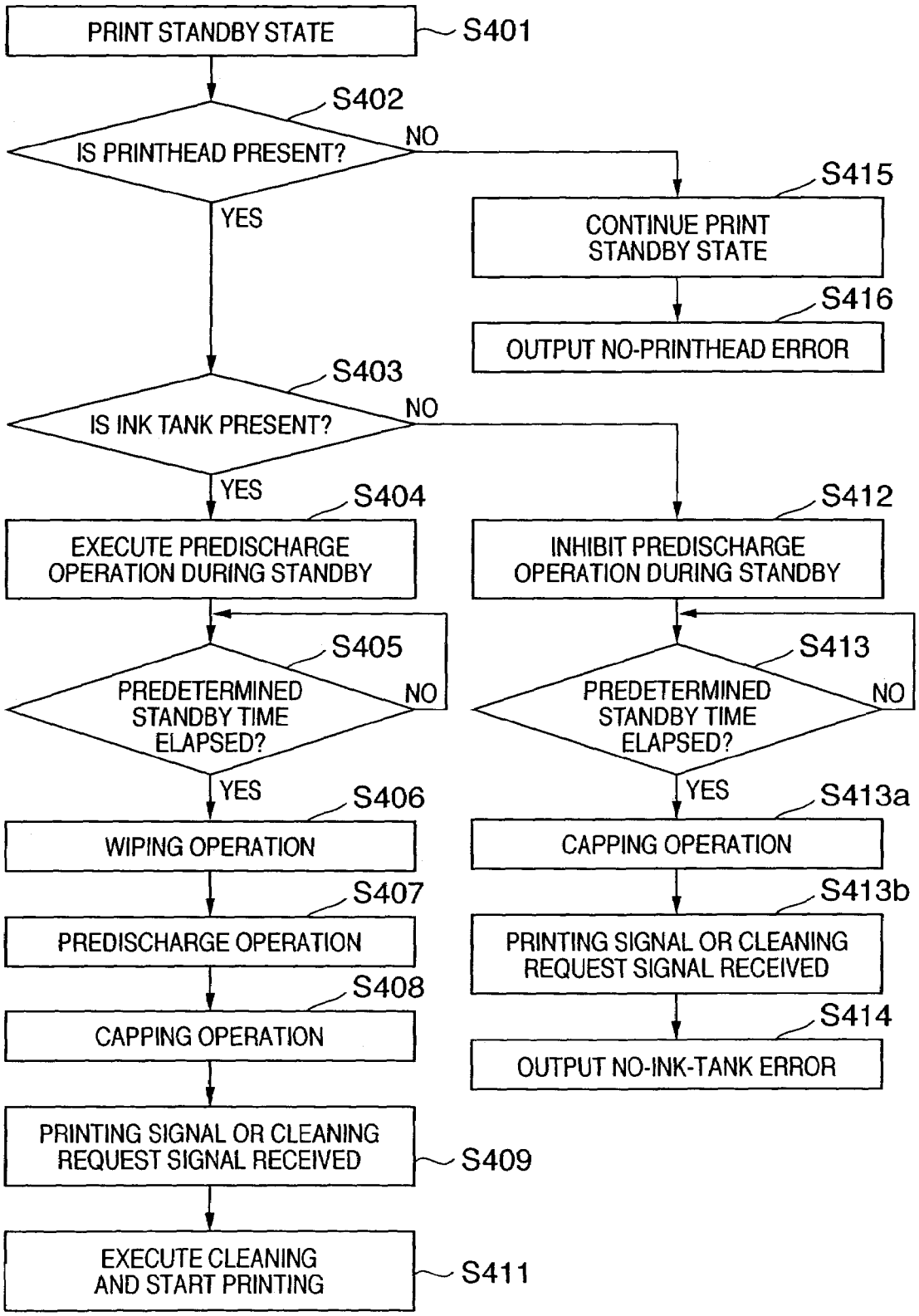
FIG. 5B is a flow chart showing control of the cleaning operation executed by the inkjet printing apparatus according to the first embodiment of the present invention.

In the processing shown in FIG. 5A, step S410 may be omitted, and the processing may branch into two sequences depending on the determination result in step S403, as shown in FIG. 5B.

As described above, according to the first embodiment, the presence/absence of the ink tank is detected, and on the basis of the detection result, the cleaning operation is inhibited. With this arrangement, damage to the printhead by any unnecessary cleaning operation can be suppressed. Hence, the service life of the apparatus can be prolonged.

In addition, since any unnecessary cleaning operation is suppressed, wasteful ink consumption can also be suppressed.

<Second Embodiment>

In the first embodiment, an arrangement that detects the presence/absence of the ink tank and inhibits the cleaning operation on the basis of the detection result has been described.

In an inkjet printing apparatus 1 in which ink tanks 9 are normally attached, for example, the continuous time of the state of each constituent element in the inkjet printing apparatus 1, such as the unused time of a printhead 3 or the open time of a cap C, can be measured by a timer 313 on a control circuit F (FIG. 4).

These measured times can be used for various control operations. For example, the cleaning level (cleaning time or the number of times of cleaning) in the cleaning operation can be changed in accordance with the unused time of the printhead 3. Alternatively, a necessary cleaning operation can be executed when the open time of the cap C exceeds a specified time.

When various cleaning request signals are simultaneously received, the inkjet printing apparatus 1 compares the cleaning levels. Only cleaning with the highest level is executed, and the remaining cleaning requests are cleared. This arrangement prevents cleaning more than necessary and wasteful ink consumption.

In the second embodiment, to more appropriately solve adhesion in the ink channel of the ink-jet printhead, which is caused by ink remaining in it depending on the unattached time (shelf period) of the ink tank 9 to the printhead 3, an arrangement which executes the cleaning operation in accordance with the unattached time will be described.

The inkjet printing apparatus 1 of certain type has an internal power supply such as a battery in addition to a normal external power supply. Especially, the inkjet printing apparatus 1 having an internal power supply can implement the print operation or continuously hold the contents of a temporary memory such as a DRAM or SRAM arranged on the control circuit F even when no power is supplied from the external power supply.

The timer 313 can operate independently of the presence/absence of power from the external power supply or an apparent power ON state (soft ON state) or power OFF state (soft OFF state).

In the second embodiment, control of the cleaning operation in the inkjet printing apparatus 1 having an internal power supply and the inkjet printing apparatus 1 having only the external power supply will be described.

I. Control of Cleaning Operation of Apparatus with Internal Power Supply

As the outline of control of the cleaning operation executed by an MPU 38, the start and end of time counting by the timer 313 are executed on the basis of the detection result from an ink tank detection section A, thereby measuring the unattached time of the ink tank 9.

The measured unattached time is stored in, e.g., an EEPROM 311. The unattached time stored in the EEPROM 311 is read out and determined. On the basis of the determined unattached time, a cleaning instruction is issued to execute the ink vacuum recovery operation, wiping operation, and ink predischarge operation.

CONTROL EXAMPLE 1-1 OF I

The ink tank detection section A detects detachment of the ink tank 9. Upon receiving a signal representing it from the ink tank detection section A, the MPU 38 starts time counting by the timer 313. The inkjet printing apparatus 1 has an internal power supply which can maintain time counting by the timer 313. Hence, even when power supply from the external power supply is stopped, the time counting operation by the timer 313 continues without any influence.

When the ink tank detection section A detects attachment of the ink tank 9, the MPU 38 stops time counting by the timer 313. Accordingly, the unattached time of the ink tank 9 is determined. The unattached time is stored in the EEPROM 311.

Next, the MPU 38 looks up a cleaning level decision table (FIG. 6) stored in a ROM 310 to decide the cleaning level corresponding to the unattached time stored in the EEPROM 311.

FIG. 6 shows, as cleaning levels, ink vacuum recovery and ink predischarge levels corresponding to the elapse times (e.g., unattached time or unused time) of a state of the ink tank while defining that the levels of ink vacuum recovery and ink predischarge for the Bk ink and color inks (C, M, and Y) as the cleaning operation in the normal state are "1". For example, when the elapse time is 120 hrs, the cleaning operation is executed at a level twice as high as the normal cleaning operation.

After decision of the cleaning level, when the inkjet printing apparatus 1 is set in an operable state by an operation of, e.g., closing the cover of the inkjet printing apparatus 1, the cleaning operation is immediately executed on the basis of the decided cleaning level.

If another cleaning request signal from another factor has already been set, the decided cleaning level is compared with that indicated by the cleaning request signal. The cleaning operation is executed at a higher cleaning level.

The unattached state of the ink tank 9 is a state wherein the printhead 3 is left to stand without being used for printing for a long time. After the ink tank 9 is attached, the above-described processing is preferably performed in order to execute the cleaning operation as soon as possible to recover the ink discharge performance of the printhead 3. However, it may be conceivable that the user temporarily detaches the ink tank 9 and attaches it again but does not immediately execute the print operation.

In this situation, if the ink tank 9 attached again is not used for a long time, and the cleaning operation is executed at each of times of reattachment of the ink tank 9 and the print operation after the elapse of the long-time unused time, the ink in the ink tank 9 is wasted. To suppress ink consumption, the following control can also be taken into consideration.

CONTROL EXAMPLE 1-2 OF I

The ink tank detection section A detects detachment of the ink tank 9. Upon receiving a signal representing it from the ink tank detection section A, the MPU 38 starts time counting by the timer 313. The inkjet printing apparatus 1 has an internal power supply which can maintain time counting by the timer 313. Hence, even when power supply from the external power supply is stopped, the time counting operation by the timer 313 continues without any influence.

When the ink tank detection section A detects attachment of the ink tank 9, and a printing signal or cleaning request signal is received, the MPU 38 stops time counting by the timer 313. Accordingly, the unattached time of the ink tank 9 is determined. The unattached time is stored in the EEPROM 311.

That is, in this case, even after the ink tank 9 is attached again, time counting by the timer 313 is continued until a printing signal or cleaning request signal is received.

Next, the MPU 38 looks up the cleaning level decision table (FIG. 6) stored in the ROM 310 to decide the cleaning level corresponding to the unattached time stored in the EEPROM 311. When the input signal is a cleaning request signal, the decided cleaning level is compared with that indicated by the cleaning request signal. The cleaning operation is executed at a higher cleaning level.

CONTROL EXAMPLE 2-1 OF I

In the inkjet printing apparatus 1, to manage the unused time of the ink tank 9 in the normal attached state or the duration of the print operation, a relative clock (a soft timer by the MPU 38) in the inkjet printing apparatus 1 is operated to manage the time of the state of each constituent component of the inkjet printing apparatus 1. A cleaning operation based on the unattached time of the ink tank 9, which is measured by using the relative clock, will be described here.

The ink tank detection section A detects detachment of the ink tank 9. Upon receiving a signal representing it from the ink tank detection section A, the MPU 38 stores the time indicated by the relative clock in the EEPROM 311.

Next, the MPU 38 reads out the time of the relative clock corresponding to the time when the ink tank detection section A has detected the attachment of the ink tank 9 and compares the readout time with the time stored in the EEPROM 311 to determine the unattached time of the ink tank 9. The unattached time is stored in the EEPROM 311.

The subsequent operation is the same as in control example 1-1 of I, and a description thereof will be omitted.

CONTROL EXAMPLE 2-2 OF I

In control example 2-1 of I, determination of the unattached time of the ink tank 9 may be done by executing the same operation as in control example 1-2 of I. That is, when the ink tank detection section A detects attachment of the ink tank 9, and a printing signal or cleaning request signal is received, the MPU 38 reads out the time of the relative clock at that time and compares the readout time with the time stored in the EEPROM 311 to determine the unattached time of the ink tank 9. The unattached time is stored in the EEPROM 311.

The subsequent operation is the same as in control example 1-2 of I, and a description thereof will be omitted.

In the above-described control examples 1-1 to 2-2 of I, the timer 313 and relative clock (a soft timer by the MPU 38) themselves may always operate independently of the attached or detached state of the ink tank. Time counting may be started and ended in accordance with the detachment and attachment of the ink tank.

Control of the cleaning operation in the inkjet printing apparatus 1 having no internal power supply, i.e., having only the external power supply, will be described next.

II Control of Cleaning Operation of Apparatus with Only External Power Supply

Normally, the inkjet printing apparatus 1 which has no internal power supply capable of maintaining the time counting value of the timer 313 receives time information from the side of a host apparatus 10. This time information is contained in a signal such as a printing signal or cleaning request signal issued by a so-called printer driver installed in the host apparatus 10. The time information is received usually every time the external power supply (AC power supply) is turned on (every hard ON). After that, no time information is received generally (although the time information is received, the time value is not updated).

A reason for this is as follows. Even when the inkjet printing apparatus 1 is apparently set in the power OFF state (soft OFF state) by the key operation, the relative clock (or the timer 313) of the MPU 38 provided on the control circuit F can be operated, and time management can be executed as long as the external power is supplied.

As another reason, when a plurality of host apparatuses 10 use one inkjet printing apparatus, the adverse effect of time lag between the plurality of host apparatuses 10 (e.g., a problem that time earlier than that held by the inkjet printing apparatus is input) is minimized by limiting the opportunity of time reception.

More specifically, the time information is received from the host apparatus 10 generally at the time of hard ON. On the basis of this time, the relative clock of the MPU 38 of the inkjet printing apparatus 1 is started. The time (clock) is used until hard OFF.

In this situation, in addition to the above-described control example I, the MPU 38 acquires time when the ink tank 9 is detached and stores the acquired time in the EEPROM 311. The MPU 38 also acquires time when the ink tank 9 is attached and compares the time with that stored in the EEPROM 311 to determine the unattached time of the ink tank 9. On the basis of the determined unattached time, a cleaning instruction is issued to execute the ink vacuum recovery operation, wiping operation, and ink predischarge operation.

In the hard ON state (a state wherein the relative clock of the MPU 38 of the inkjet printing apparatus 1 can operate), time management can be executed by the MPU 38 of the inkjet printing apparatus 1. On the basis of the time management result, control example 2-1 or 2-2 of I can be applied.

However, if the unattached state of the ink tank 9 or the unused state of the inkjet printing apparatus 1 continues for a long time, it can be estimated that hard OFF occurs at a high probability. In this case, when the time information is acquired from the host apparatus 10, time counting by the relative clock of the MPU 38 is started, and then, control example 2-1 or 2-2 of I is applied.

Even in the above-described control example of the inkjet printing apparatus having no internal power supply, the relative clock (soft timer) by the MPU 38 or timer 313 may always operate independently of the attached or detached state of the ink tank as long as the timer operation itself is possible. Time counting may be started and ended in accordance with the detachment and attachment of the ink tank.

As described above, according to the second embodiment, on the basis of the normal use state, i.e., a state wherein both the printhead 3 and the ink tank 9 are normally attached but not used, or the unattached time of the ink tank 9, the cleaning level of the cleaning operation to be executed subsequently is decided, and cleaning of the printhead 3 is executed. With this arrangement, a more appropriate cleaning operation can be applied to the printhead 3, and a satisfactory print quality of the inkjet printing apparatus 1 can be maintained.

In the second embodiment, two types of control examples have been described as the control examples of the cleaning operation. When the inkjet printing apparatus 1 has an internal power supply, the types of control examples can be combined. It is more preferable because the correctness of time management further improves.

Control based on the combination of the first and second embodiments may be executed.

As an example of this control, for example, when a long-time unused state continues in the unattached state of the ink tank, the unattached time is measured. The unattached time is stored in the EEPROM 311 at a predetermined time interval or when the apparatus is set in the standby state next time. When a cleaning request signal or printing signal is received, no-ink-tank error information representing that the ink tank 9 is not attached is output, as described in FIG. 5A or 5B.

When the ink tank 9 is newly attached, and a cleaning request signal or printing signal is received, the cleaning level of the cleaning operation can be decided on the basis of the unattached time stored in the EEPROM 311, and the cleaning operation can be executed.

The functions of the control circuit of the inkjet printing apparatus in the above-described first or second embodiment can be implemented by a computer. The present invention can be regarded as an invention of a method as procedures for implementing the functions. Since the functions can be implemented by a computer, the present invention can be applied to a computer program executed by the apparatus and a computer-readable storage medium such as a CD-ROM that stores the computer program and can be loaded by the computer.

In the description of the above embodiments, droplets discharged from the printhead are ink droplets, and the liquid stored in the ink tank is ink. However, the liquid stored is not limited to ink. For example, a kind of process solution which is discharged to a printing medium to increase the fixing effect and waterproof of a printed image or increase the image quality may be stored in the ink tank.

In the above embodiments, particularly, when, of inkjet printing systems, a system which comprises a means (e.g., an electrothermal transducer or laser beam) for generating heat energy as energy utilized to discharge ink and changes the ink state by heat energy is used, the printing density and resolution can be increased.

As a representative arrangement or principle, the present invention preferably adopts the basic principle disclosed in, e.g., U.S. Pat. Nos. 4,723,129 or 4,740,796. This system is applicable to both so-called on-demand and continuous apparatuses. The system is particularly effective for the on-demand apparatus because of the following reason. That is, at least one driving signal which corresponds to printing information and gives a rapid temperature rise exceeding nucleate boiling is applied to an electrothermal transducer arranged in correspondence with a sheet or liquid channel holding a liquid (ink). This signal causes the electrothermal transducer to generate heat energy, and causes film boiling on the heat effecting surface of the printhead. Consequently, a bubble can be formed in the liquid (ink) in one-to-one correspondence with the driving signal. Growth and shrinkage of the bubble discharge the liquid (ink) from an orifice, forming at least one droplet. The driving signal more preferably has a pulse shape because a bubble grows and shrinks instantaneously at an appropriate timing to discharge the liquid (ink) with high response.

The pulse-like driving signal is preferably a signal disclosed in U.S. Pat. Nos. 4,463,359 or 4,345,262. Conditions disclosed in U.S. Pat. No. 4,313,124 which is an invention concerning the temperature rise ratio of the heat effecting surface can provide higher-quality printing.

The printhead structure can be a combination (linear liquid channel or right-angle liquid channel) of orifices, liquid channels, and electrothermal transducers as those disclosed in the above-mentioned specifications. The present invention also includes structures disclosed in U.S. Pat. Nos. 4,558,333 and 4,459,600 in which the heat effecting surface is arranged in a bent region. The effects of the present invention are also effective for a structure based on Japanese Patent Laid-Open No. 59-123670 which discloses a structure in which a common slot serves as the discharge portions of electrothermal transducers, and a structure based on Japanese Patent Laid-Open No. 59-138461 which discloses a structure in which an opening for absorbing the pressure wave of heat energy corresponds to a discharge portion.

The present invention can also be effectively applied to a full line type printhead having a length corresponding to the maximum width of a printing medium printable by the printing apparatus. Such printhead may take a structure which meets this length by a combination of a plurality of printheads or a single integrated printhead structure as disclosed in the above-described specifications.

The present invention is effective in the use of not only the above-described cartridge type printhead in which an ink tank is integrated with a printhead itself but also an interchangeable chip type printhead which can be electrically connected to an apparatus main body and receive ink from the apparatus main body when attached to the apparatus main body or can receive ink supplied from the apparatus main body.

The above-described embodiments assume that ink is a liquid. It is also possible to use ink which solidifies at room temperature or less and softens or liquefies at room temperature. A general apparatus performs temperature control such that the viscosity of ink falls within a stable discharge range by adjusting the temperature of ink itself within the range of 30° C. (inclusive) to 70° C. (inclusive). Ink which liquefies when applied with a printing signal in use may be used.

In order to positively prevent a temperature rise caused by heat energy by using the temperature rise as energy of the state change from the solid state to the liquid state of ink, or to prevent evaporation of ink, ink which solidifies when left to stand and liquefies when heated can be used. In any case, the present invention is applicable to any ink which liquefies only when heat energy is applied, such as ink which liquefies when applied with heat energy corresponding to a printing signal and is discharged as liquid ink, or ink which already starts to solidify when arriving at a printing medium. As described in Japanese Patent Laid-Open No. 54-56847 or 60-71260, this type of ink can be held as a liquid or solid in a recess or through-hole in a porous sheet and opposed to an electrothermal transducer in this state. In the present invention, it is most effective to execute the aforementioned film boiling method for each ink described above.

Furthermore, the printing apparatus according to the present invention may take the form of an integrated or separate image output terminal for an information processing device such as a computer. The printing apparatus may also take the form of a copying apparatus combined with a reader, or a facsimile apparatus having a transmission/reception function.

<Other Embodiments>

Note that the present invention can be applied to an apparatus comprising a single device or to system constituted by a plurality of devices.

Furthermore, the invention can be implemented by supplying a software program, which implements the functions of the foregoing embodiments, directly or indirectly to a system or apparatus, reading the supplied program code with a computer of the system or apparatus, and then executing the program code. In this case, so long as the system or apparatus has the functions of the program, the mode of implementation need not rely upon a program.

Accordingly, since the functions of the present invention are implemented by computer, the program code installed in the computer also implements the present invention. In other words, the claims of the present invention also cover a computer program for the purpose of implementing the functions of the present invention.

In this case, so long as the system or apparatus has the functions of the program, the program may be executed in any form, such as an object code, a program executed by an interpreter, or scrip data supplied to an operating system.

Examples of storage media that can be used for supplying the program are a floppy disk, a hard disk, an optical disk, a magneto-optical disk, a CD-ROM, a CD-R, a CD-RW, a magnetic tape, a non-volatile type memory card, a ROM, and a DVD (DVD-ROM and a DVD-R).

As for the method of supplying the program, a client computer can be connected to a website on the Internet using a browser of the client computer, and the computer program of the present invention or an automatically-installable compressed file of the program can be downloaded to a recording medium such as a hard disk. Further, the program of the present invention can be supplied by dividing the program code constituting the program into a plurality of files and downloading the files from different websites. In other words, a WWW (World Wide Web) server that downloads, to multiple users, the program files that implement the functions of the present invention by computer is also covered by the claims of the present invention.

It is also possible to encrypt and store the program of the present invention on a storage medium such as a CD-ROM, distribute the storage medium to users, allow users who meet certain requirements to download decryption key information from a website via the Internet, and allow these users to decrypt the encrypted program by using the key information, whereby the program is installed in the user computer.

Besides the cases where the aforementioned functions according to the embodiments are implemented by executing the read program by computer, an operating system or the like running on the computer may perform all or a part of the actual processing so that the functions of the foregoing embodiments can be implemented by this processing.

Furthermore, after the program read from the storage medium is written to a function expansion board inserted into the computer or to a memory provided in a function expansion unit connected to the computer, a CPU or the like mounted on the function expansion board or function expansion unit performs all or a part of the actual processing so that the functions of the foregoing embodiments can be implemented by this processing.

As many apparently widely different embodiments of the present invention can be made without departing from the spirit and scope thereof, it is to be understood that the invention is not limited to the specific embodiments thereof except as defined in the appended claims.

What is claimed is:

1. An inkjet printing apparatus which includes a printhead that discharges ink and an ink tank detachably attached to the printhead, and executes printing by using the printhead that discharges the ink supplied from the ink tank, comprising:

detection means for detecting presence/absence of the ink tank;

cleaning means for cleaning the printhead; and control means for inhibiting a cleaning operation by said cleaning means when said detection means detects presence/absence of the ink tank and indicates that the ink tank is not attached to the printhead in a case that the cleaning operation is intended to be executed at a predetermined timing during print standby.

2. The apparatus according to claim 1, wherein when the ink tank is not attached to the printhead, and a printing signal is received, said control means also inhibits a printing operation by the printhead.

3. The apparatus according to claim 1, further comprising output means for, when a cleaning request signal or a printing signal is received in a state in which said detection means detects that the ink tank is not attached to the printhead, outputting information representing that the ink tank is not attached to the printhead.

4. The apparatus according to claim 1, wherein the ink tank comprises a plurality of ink tanks which store a plurality of types of ink, respectively, and each of the plurality of ink tanks is detachably attached to the printhead.

5. A method of controlling an inkjet printing apparatus which includes a printhead that discharges ink and an ink tank detachably attached to the printhead, and executes printing by using the printhead that discharges the ink supplied from the ink tank, comprising:

a detection step of detecting presence/absence of the ink tank; and a control step of inhibiting a cleaning operation by a cleaning section that cleans the printhead when said detection step detects presence/absence of the ink tank and indicates that the ink tank is not attached to the printhead in a case that the cleaning operation is intended to be executed at a predetermined timing during print standby.

6. A program which implements control of an inkjet printing apparatus which includes a printhead that discharges ink and an ink tank detachably attached to the printhead, and executes printing by using the printhead that discharges the ink supplied from the ink tank, comprising:

a program code for a detection step of detecting presence/absence of the ink tank; and a program code for a control step of inhibiting a cleaning operation by a cleaning section that cleans the printhead when said detection step detects presence/absence of the ink tank and indicates that the ink tank is not attached to the printhead in a case that the cleaning operation is intended to be executed at a predetermined timing during print standby.

* * * * *